United States Patent [19]

Gillespie et al.

[11] 4,345,710

[45] Aug. 24, 1982

[54] TEMPORARY MATERIAL RECEPTACLE

[76] Inventors: Donald R. Gillespie, R.D. #2, Stump Rd., Skaneateles, N.Y. 13152; John M. French, Jr., 314 Garden City Dr., Mattydale, N.Y. 13211

[21] Appl. No.: 245,941

[22] Filed: Mar. 20, 1981

[51] Int. Cl.[3] ..... B65D 5/52; B65D 91/00

[52] U.S. Cl. ..... 229/16 R; 248/156; 232/17

[58] Field of Search ..... 229/16 R; 232/17, 45, 232/39; 248/127, 128, 146, 152, 156

[56] References Cited

U.S. PATENT DOCUMENTS

| | | | |
|---|---|---|---|
| 2,443,690 | 6/1948 | Mitchell | 232/17 |
| 3,042,293 | 7/1962 | Miller | 232/45 |
| 3,214,075 | 10/1965 | Champlin | 229/16 R |
| 3,263,905 | 8/1966 | Kucka | 232/17 |
| 3,434,646 | 3/1969 | Schmidt | 229/16 R |

*Primary Examiner*—Herbert F. Ross

*Attorney, Agent, or Firm*—Bruns & Jenney

[57] ABSTRACT

A temporary material receptacle that is suitable for use in snowbound regions in which delivery boxes are oftentimes buried under deep drifts or torn away by snow plowing equipment. The receptacle is formed by folding a single blank of suitable material into a rectangular shaped open ended housing that is supported in a generally horizontal position by a vertical standard. The standard can be easily inserted into a snowbank to provide for a temporary depository that is capable of shielding material contained therein from the elements. Alternatively, the standard can be secured as by stapling to an existing post or pole.

8 Claims, 3 Drawing Figures

TEMPORARY MATERIAL RECEPTACLE

BACKGROUND OF THE INVENTION

This invention relates to a temporary receptacle for protecting printed material and the like from the elements, and, in particular, to a material repository that is formed by folding a single blank of suitable material along precut fold lines.

In many northern rural areas newspapers and the like are delivered by automobile to post mounted receptacles situated along the side of the road. During the winter months, the snowfall can become heavy and drifting and blowing of the snow presents a serious problem. Continual plowing of the roads oftentimes becomes necessary whereupon the receptacle is buried under drifts and cannot be located. Similarly, because of adverse weather conditions, plow operators may also inadvertently strike and break the receptacle post thereby rendering it unuseable. Accordingly, delivery people following in the wake of a plow may find no place to deposit their materials other than on the top of a snowbank. If the material is not quickly recovered by the subscriber, it can become watersoaked, blow away or even be buried in the snow. In any event, safe delivery of the printed material and the like under these conditions is oftentimes extremely difficult.

Also, many news dealers conduct promotional campaigns during which time free copies of their publications are delivered to perspective customers. Because of governmental regulations these materials cannot be deposited in existing mailboxes and it is usually necessary for the promotor to provide a temporary box for the duration of the campaign. Heretofore the expense of providing temporary boxes has been relatively high.

SUMMARY OF THE INVENTION

It is therefore an object of the present invention to insure the safe delivery of newspapers and other similar materials in snowbound rural regions.

It is a further object of the present invention to provide a temporary depository for newspapers and the like for use in snowbound rural regions.

Another object of the invention is to provide an inexpensive box that can be easily secured to an existing post for use during short promotional campaigns.

A still further object of the present invention is to provide a temporary delivery receptacle for printed material and the like which is formed from a relatively inexpensive board of foldable material.

Another object of the present invention is to provide a temporary newspaper container that is easily stored and which can be quickly erected in the field by a delivery person.

These and other objects of the present invention involve a receptacle for use in snowbound regions for temporarily housing printed material or the like. The receptacle is formed from a board of inexpensive foldable material that has been scored along predetermined fold lines so that it can be quickly and easily folded into a receptacle that includes a rectangular housing and a support standard for mounting the housing in a generally horizontal position. The bottom of the standard is provided with a pointed blade that can be easily inserted into a snowbank to securely hold the receptacle in an upright position or, alternatively, provide a means for temporarily securing the housing to an existing post.

BRIEF DESCRIPTION OF THE DRAWINGS

For a better understanding of these and other objects of the present invention, reference is had to the following detailed description of the invention that is to be read in conjunction with the associated drawings wherein.

DESCRIPTION OF THE INVENTION

With reference to the drawings, wherein like component parts are identified by like numbers, the present invention involves a receptacle for temporarily protecting printed material and the like from weather in order to safeguard the material between the time it is delivered and the time it is retrieved by the intended recipient. The receptacle, which is generally referenced 10 in FIG. 1, is made up of two main sections that include an elongated rectangular shaped housing 11 and a bladed standard 12 that depends downwardly from the housing.

As previously noted, the present invention involves a temporary receptacle for newsprint or the like that can be quickly and easily attached to an existing post or, in the case of a snowstorm, inserted into a snowdrift when the permanent box is buried or destroyed by snow removal equipment or an eratic driver. Preferably, the receptacle is formed from a single flat board of any suitable, inexpensive material that has been scored along predetermined fold lines to permit the board to be rapidly and accurately folded into a self-locking relatively strong structure capable of protecting printed matter and the like from the elements. A supply of blanks can be stored in a flat stack in the delivery person's motor vehicle and, when needed, simply folded and locked into the configuration shown in FIG. 1. In operation the standard can be inserted into a snowbank at the side of the road close to the recipient's location or alternatively secured to an existing post using staples, tacks, wires or the like.

The board can be made of any suitable foldable material such as a wide variety of relatively inexpensive paper or plastic boards that are presently commercially available. When a paperboard blank is used it is preferably treated with a thin coating of waterproof or resistant material that will serve to keep the board dry for a relatively long period of time despite adverse weather conditions. Such coatings are well known in the art and are readily available through suppliers of paperboard. In light of the fact that the present device is not intended to be used as a permanent installation, the use of a relatively inexpensive treated paperboard as a construction material is entirely satisfactory.

Figure 1:
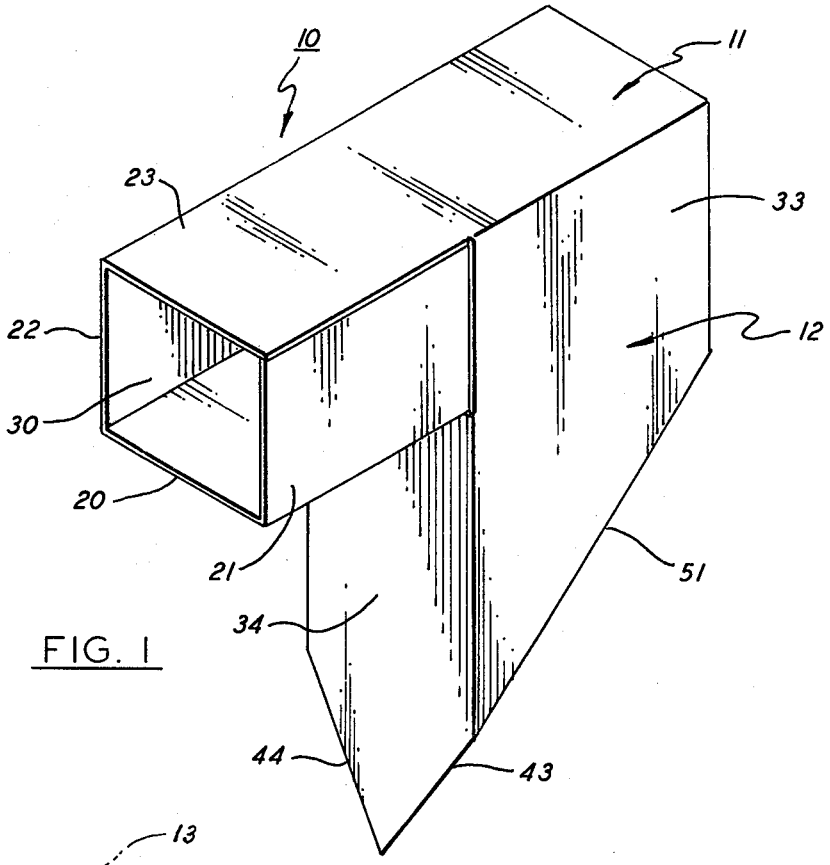
FIG. 1 is a perspective view of the receptacle embodying the teachings of the present invention.
Figure 3:
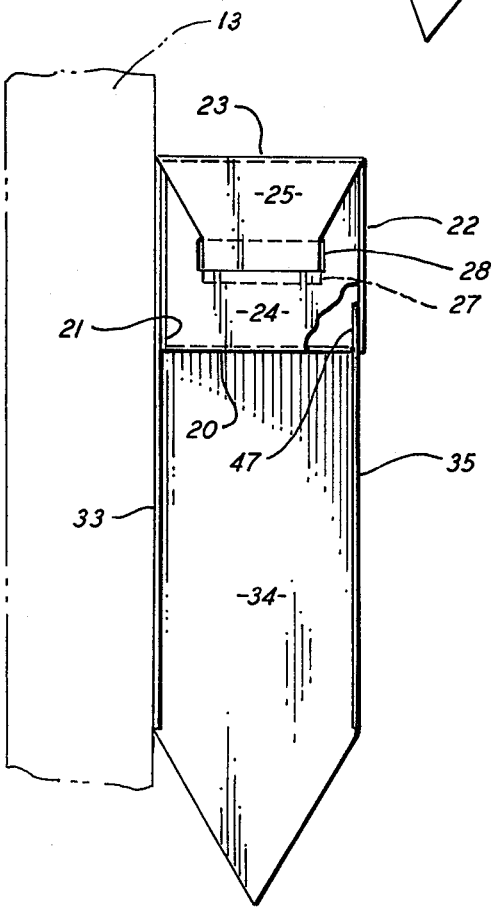
FIG. 3 is a rear view of the present receptacle showing it secured in an upright position to a post.
Figure 2:
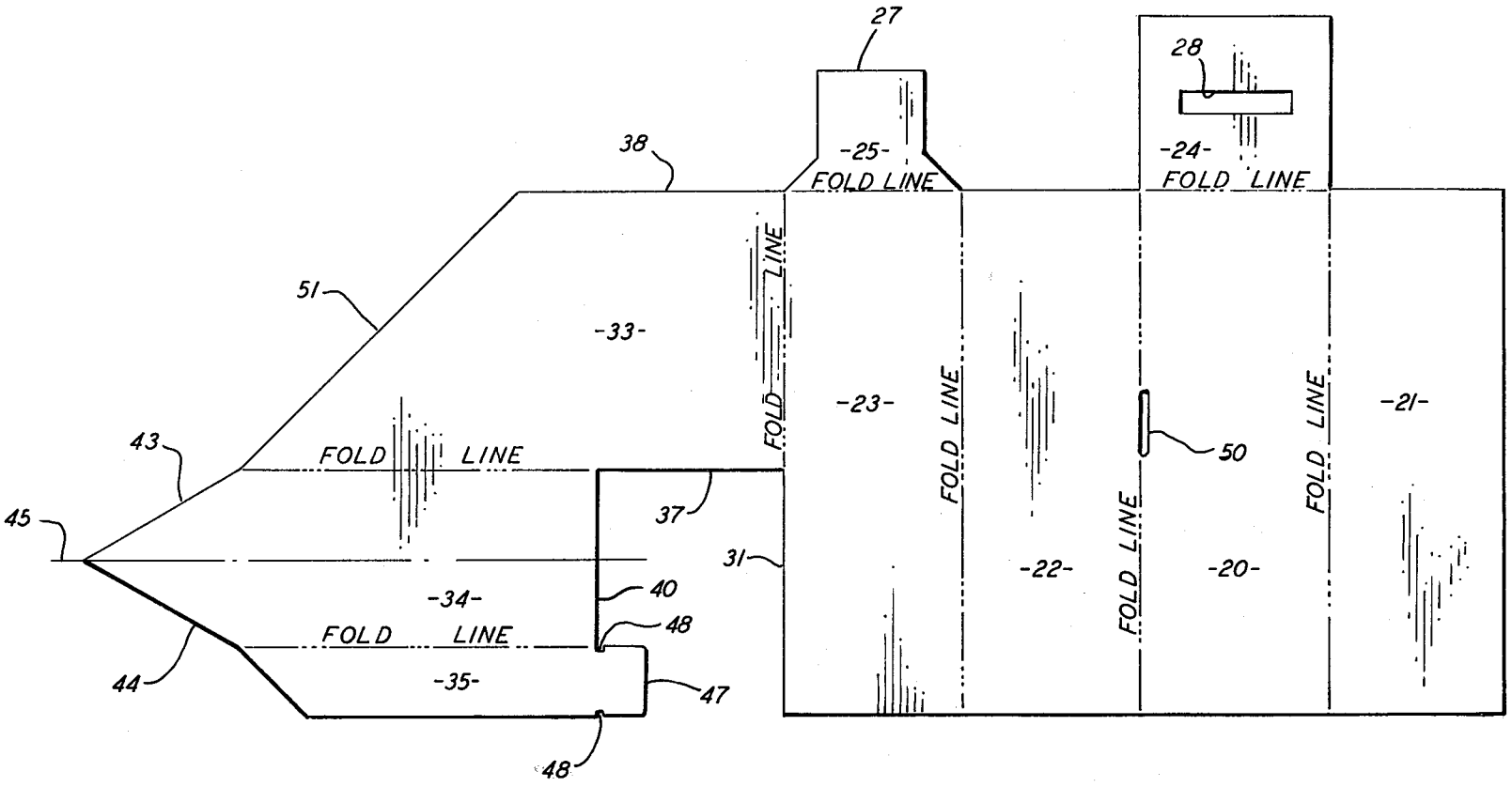
FIG. 2 is a top plan view of a blank of foldable material that has been scored to provide foldlines to enable the blank to be quickly folded into the receptacle illustrated in FIG. 1.

As shown in FIGS. 1–3, the housing of the present device is formed of four rectangular shaped panels of equal length. These include a bottom panel 20, two side panels 21 and 22 and a top panel 23. The lower edges of the two side panels are foldably connected or attached to the two side edges of the bottom panel by scoring a fold line in the board along the line of joinder between the adjacent panels. It should be noted at this point that all the fold lines which are used to connect the various panels of the present invention involve straight line folds that can be easily cut during the blank forming operation.

A back panel 24 is foldably connected to the rear edge of the bottom wall which folded, in assembly, is brought upwardly to a position that is perpendicular with the bottom panel to form the rear wall for the housing. A rear closure panel 25 is foldably attached to the back edge of the top panel 23 which is folded downwardly in assembly. The closure panel contains a rectangular shaped tongue 27 that is slidably received in a slotted hole 28 formed in back panel 24. As best seen in FIG. 3, the two rear panels interlock in assembly to totally enclose the back of the housing to provide added protection for material placed in the housing and also provide added structural strength to the assembly. An opening 30 is provided in the front of the housing through which material is passed therein.

The support standard section 12 of the present invention involves three cojoined panels that are foldably connected to the side edge 31 of top panel 23. These panels include a main support panel 33, a bladed front panel 34 and a locking panel 35.

The main support panel 33 contains two parallel side edges 37 and 38 which are normal to the side edge 31 of the top panel as illustrated in FIG. 2. The width of the support panel is about half the length of the top panel to which it is appended. The rear side edge 38 of the support panel is cut in the blank so that it is coplanar with the back edge of the top panel. As illustrated in FIG. 1, the support panel, when folded in assembly, depends downwardly from the top panel and is held in overlying contact against right side panel 21 of the housing.

The bladed front panel 34 of the support standard section is foldably connected to the main support panel along edge 37. The width of the bladed panel is substantially equal to the width of the bottom panel 20 of the housing section. The blank is cut so that the top edge 40 of the bladed section is parallel with the side edge 31 of the housing section top panel 23 prior to folding. The distance between edges 40 and 31, as shown in FIG. 2, is substantially equal to the width of the housing side panels 21 and 22. The bladed panel, in assembly, is folded under the housing at a right angle to the support panel as shown in FIG. 1 to position it directly below the midsection of the housing. The blank is accurately cut so that the edge 40 of the bladed panel will fit snuggly against the bottom surface of the housing to provide added support to the housing in assembly.

The lower or distal end of the bladed panel 34 is brought to a relatively sharp point by means of two oblique edges 43 and 44 that are arranged to meet and form an apex at the longitudinal axis 45 of the panel. The blade-like configuration of panel 34 permits the temporary receptacle to be easily inserted to a sufficient depth in a bank of snow to firmly anchor the device in place as shown in FIG. 3. The standard may also be placed against an existing post, such as post 13, and secured thereto using a staple gun or the like.

The entire assembly is locked in place by means of a locking panel 35 that contains a locking tab 47 extending outwardly from the top edge of the panel. The locking tab is undercut slightly at the point where it joins panel 35 by means of a pair of notches 48—48 which permits the tab to be bent along the line of joinder with the panel without unduly weakening the structure. In assembly, the locking panel is turned rearwardly 90° from the bladed panel and the locking tab is inserted into a slotted hole 50 formed in the bottom panel 20 of the housing section. Once the tab is locked in place, the entire assembly will be prevented from moving or otherwise shifting out of the desired position.

The lower edges 51 and 52 of support panel 33 and locking panel 35, respectively, are inclined upwardly away from the bladed panel as shown in FIG. 2. The upward inclination of the two edges presents a sloping edge to the snow when the standard is inserted into a snowbank thereby making insertion of the device relatively easy to achieve.

While this invention has been described with reference to the structure disclosed herein, it is not confined to the details set forth and this application is intended to cover any modifications or changes as may come within the scope of the following claims.

We claim:

1. A self-locking receptacle for printed material and the like that is formed by folding a single board of foldable material that includes a rectangular bottom panel, a pair of complimentary rectangular side panels, each side panel being of substantially the same length as the bottom panel and having its lower side edge foldably attached to one of the side edges of the bottom panel, a rectangular top panel being of substantially the same length as the side bottom panels having a first one of its two side edges foldably attached to the upper side edge of one of the side panels whereby the four cojoined panels can be folded into a rectangular housing, an elongated support panel foldably attached to the second side edge of the top panel and having at least one longitudinal side edge that is normal to said second side edge of the top panel, the width of said support panel being less than the length of the top panel, a rectangular shaped bladed front panel foldably attached to said one side edge of the support panel, the top edge of the front panel being parallel with the second side edge of the top panel and being spaced therefrom a distance that is substantially equal to the width of the side panels, the width of the front panel being substantially equal to the width of the bottom panel, and the bottom portion thereof terminating in a point, a locking panel foldably attached to a second side edge of the bladed panel, the top edge of the locking panel being coplanar with the top edge of the blade panel, a locking tab foldably attached to the top edge of the locking panel, and said bottom panel having a slotted hole formed therein for receiving the locking tab therein.

2. The receptacle of claim 1 that further includes a pair of coacting rear wall panels foldably attached to the rear edges of a pair of opposed housing forming panels having interlocking means associated therewith for joining the coacting panels in assembly to provide a rear wall to said housing.

3. The receptacle of claim 1 wherein the bottom edges of the support panel and the bottom edge of the locking panel both slope outwardly and rearwardly away from the bladed front panel.

4. The receptacle of claim 1 wherein the slotted hole formed in the bottom panel is located adjacent to one side edge of said panel and is longitudinally extended along said adjacent side edge.

5. The receptacle of claim 1 wherein said foldable material is paperboard that contains a thin outer layer of moisture resistant material.

6. A receptacle for printed material such as newspapers or the like that includes a single sheet of foldable material that is folded to form a rectangular shaped housing having a bottom wall, two opposed side walls and a top wall, said housing having a main support panel depending downwardly from one side edge of the top wall of the housing with the support panel being contiguous with one side wall of said housing, a bladed front panel foldably secured to the support panel that passes laterally beneath the bottom wall of the housing with the top edge of the front panel seated in supporting contact against the bottom wall of the housing, the bottom section of said front panel terminating in a point and a locking tab attached to said front panel that is slidably received within a slotted hole formed in the bottom wall of the housing for locking the folded sheet in assembly.

7. The receptacle of claim 6 wherein said housing further includes a back wall.

8. The receptacle of claim 6 wherein said foldable material is paperboard that includes an outer layer of moisture resistant material.

* * * * *